US008916763B2

(12) United States Patent
Tetsuro

(10) Patent No.: US 8,916,763 B2
(45) Date of Patent: Dec. 23, 2014

(54) TRANSDUCER

(76) Inventor: Tsuji Tetsuro, Aichi (JP)

( * ) Notice: Subject to any disclaimer, the term of this patent is extended or adjusted under 35 U.S.C. 154(b) by 232 days.

(21) Appl. No.: 13/807,124

(22) PCT Filed: Jul. 26, 2011

(86) PCT No.: PCT/JP2011/066957

§ 371 (c)(1),
(2), (4) Date: Dec. 27, 2012

(87) PCT Pub. No.: WO2012/014888

PCT Pub. Date: Feb. 2, 2012

(65) Prior Publication Data

US 2013/0098228 A1 Apr. 25, 2013

(30) Foreign Application Priority Data

Jul. 30, 2010 (JP) ..... 2010-171288

(51) Int. Cl.
*G10H 3/14* (2006.01)
*G10H 3/18* (2006.01)

(52) U.S. Cl.
CPC ..... *G10H 3/143* (2013.01); *G10H 3/183* (2013.01); *G10H 3/146* (2013.01); *G10H 2220/525* (2013.01)
USPC ..... 84/730; 84/743

(58) Field of Classification Search
USPC ..... 84/730
See application file for complete search history.

(56) References Cited

U.S. PATENT DOCUMENTS 7,105,731 B1 * 9/2006 Riedl ..... 84/200

FOREIGN PATENT DOCUMENTS

| | | |
|---|---|---|
| JP | 11-173876 | 7/1999 |
| JP | 2007-211513 | 8/2007 |
| JP | 3146385 | 10/2008 |
| JP | 2009-093199 | 4/2009 |

* cited by examiner

*Primary Examiner* — Christopher Uhlir
(74) *Attorney, Agent, or Firm* — Greenblum & Bernstein, P.L.C.

(57) ABSTRACT

Provided is a transducer that can be attached to a desired position and removed therefrom and that does not damage musical instruments. A first magnet member and a second magnet member are mutually attracted toward one another by magnetic force across the top board of a ukulele. Thus, a receiver unit including a piezoelectric element, which is supported by the first magnet member, can be positioned at a desired position. Because the receiver unit is kept in position only by the mutually attracting magnetic forces, the receiver unit can be moved to any desired position even after once being positioned on the top surface of the ukulele.

8 Claims, 14 Drawing Sheets

TRANSDUCER

TECHNICAL FIELD

The present invention relates to a transducer.

BACKGROUND ART

Conventionally, transducers, such as contact pickups, for transducing the vibrations of a cord into electric signals are widely used in string instruments such as acoustic guitars. For example, Patent Document 1 discloses a transducer attached to the body of a string instrument via an adhesive layer made of rubber.

Patent Document 1: JP-A-2009-93199

DISCLOSURE OF THE INVENTION

Problems to be Solved by the Invention

However, such a transducer has a following problem: since such a transducer is attached to the body of a string instrument via an adhesive layer, it is difficult to remove it from the body of the string instrument once it is bonded, and it is difficult to remove the adhesive layer from the body of the string instrument when the transducer is removed.

For this reason, once the transducer is attached, it cannot be returned to the state before the attachment, and players have desired a transducer that can change the attachment position or can be removed after it is attached.

The present invention is made in view of such a problem, and the principle object of the invention is to provide an easily removable transducer.

Solutions to the Problems

The present invention employs the following means in order to achieve the above-mentioned principle object.

The transducer of the present invention includes:

a transducing member for transducing an vibration generated from an musical instrument into an electric signal;

a supporting member for supporting the transducing member;

a fixing member, placed opposite to the supporting member to pinch at least a part of the musical instrument, wherein at least one of the supporting member and the fixing member is a magnet, the supporting member and the fixing member attract each other with a magnetic force to position the transducing member.

In this transducer, one or both of the supporting member and the fixing member, which are placed at a location through at least a part of the musical instrument in between, is/are a magnet(s), and thereby they are positioned so that the supporting member and the fixing member pinches at least a part of the musical instrument due to a magnet force. In this manner, it becomes possible to position the transducer supported by the supporting member, to a desired location regardless of the shape of the musical instrument. Furthermore, since no adhesive or the like is used to attach the transducer, it becomes possible to avoid the surface of the musical instrument from being damaged or being dirty due to an adhesive or the like. In other words, it becomes possible to attach the transducer at any location, and also remove the transducer.

In the transducer of the present invention, the transducing member is a piezoelectric element, and the supporting member and the fixing member may push the transducing member toward the musical instrument by attracting each other with a magnetic force. In this manner, the transducing member is pushed toward the musical instrument, and thereby the piezoelectric element can detect vibrations generated from the musical instrument with a better sensitivity as compared with a case that the transducing member is not pushed. In addition, changing the pushing force for pushing the transducing member toward the musical instrument allows the quality/tone of the sounds output from the transducer to be changed. Furthermore, since it is not necessary to put an adhesive layer or the like in between the piezoelectric element and the musical instrument, vibrations generated from the musical instrument can be directly conveyed to the piezoelectric element.

The transducer of the present invention may include a buffer member inserted between the supporting member and the musical instrument when the transducing member is pushed against the supporting member. In this manner, it becomes possible to change the strength or wave pattern of vibrations reaching the transducing member by changing the buffer member, which is a simple operation. In other words, it becomes possible to more easily change the sound quality/tone quality of sounds generated from the transducer, as compared with a case that the buffer member is not used.

In the transducer of the present invention, the fixing member may have an adhesive element for fixing the fixing member and the musical instrument to at least a part of an abutment surface where the fixing member and the musical instrument abut with each other when the fixing member is placed. In this manner, after the transducer is placed at a desired location, the location of the fixing member can be bonded to the musical instrument. Thereby, even if the supporting member is disengaged, the supporting member can be placed at the desired location again because the fixing member is bonded to the musical instrument. In the transducer of the present invention employing this embodiment, a plurality of the fixing members may be provided. In this manner, with the plurality of the fixing members bonded to the musical instrument in advance, one can select one location from multiple locations in accordance with the playing of the musical instrument, and easily position the transducer to the selected location.

The transducer of the present invention may include an output terminal electrically connected to the transducing member, for outputting an electric signal transduced by the transducing member. In this manner, electric signals transduced by the transducing member can be output to the outside. In addition, when the transducing member is placed outside of the musical instrument, the transducing member and the output terminal can be electrically connected without any through hole provided in the musical instrument. The transducer of the present invention employing this embodiment may include: an output-terminal supporting member for supporting the output terminal; an output-terminal fixing member placed opposite to the output-terminal supporting member to pinch at least a part of the musical instrument, wherein at least one of the supporting member and the fixing member is a magnet, and the supporting member and the fixing member attract each other with a magnetic force to position the transducing member. In this manner, the transducing member and the output terminal may be positioned at a desired location without damaging the musical instrument. In other words, the player of the musical instrument may position the transducing member at a location where desired playing sounds can be transduced into electric signals, and may position the output terminal at a location where the output terminal does not interfere his/her own playing.

In the transducer of the present invention, the supporting member and the fixing member may be neodymium magnets.

In this manner, the musical instrument and the transducer are pinched by a stronger force as compared with a case that only one of the supporting member and the fixing member is a magnet, and thus they are less likely to be displaced inadvertently after they are positioned. In addition, since neodymium magnets have a high magnetic flux density compared with magnetite and ferrite magnets, the musical instrument or the transducing member can be pinched with a stronger force as compared with a case that magnetite and a ferrite magnet is used, and the receiving member is less likely to be displaced inadvertently after it is positioned.

BRIEF DESCRIPTION OF THE DRAWINGS

FIG. 5A shows a peak hold value when the receiver unit is attached at location A in FIG. 4. FIG. 5B shows a peak hold value when the receiver unit is attached at location B in FIG. 4. FIG. 5C shows a peak hold value when the receiver unit is attached at location C in FIG. 4. FIG. 5D shows a peak hold value when the receiver unit is attached at location D in FIG. 4. FIG. 5E shows a peak hold value when the receiver unit is attached at location E in FIG. 4.

FIG. 6A shows a peak hold value in the present embodiment, while FIG. 6B shows a peak hold value measured in the same conditions except that the receiver unit 30 is bonded on the surface of the ukulele 10 with a double-face adhesive tape.

FIG. 7A shows a frequency spectrum in the present embodiment, while FIG. 7B shows a frequency spectrum measured in the same conditions except that the receiver unit 30 is bonded on the surface of the ukulele 10 with a double-face adhesive tape.

FIG. 8A shows a peak hold value in the present embodiment, while FIG. 8B shows a peak hold value measured in the same conditions except that the second magnet member 34 is replaced with another magnet having a diameter of 12 mm and a thickness of 1.7 mm.

FIG. 9A shows a frequency spectrum in the present embodiment, while FIG. 9B shows a peak hold value measured in the same conditions except that the second magnet member 34 is replaced with another magnet having a diameter of 12 mm and a thickness of 1.7 mm.

FIG. 10A shows a frequency spectrum when a felt having a thickness of 1.5 mm is used as a buffer member, FIG. 10B shows a frequency spectrum when a cotton cloth is used as a buffer member, and FIG. 10C shows a frequency spectrum when a natural rubber having a thickness of 1 mm is used as a buffer member.

FIG. 11A shows a frequency spectrum when a hard rubber having a thickness of 1 mm is used as a buffer member, FIG. 11B shows a frequency spectrum when a walnut wood having a thickness of 0.5 mm is used as a buffer member, and FIG. 11C shows a frequency spectrum when a balsa wood having a thickness of 1 mm is used as a buffer member.

DESCRIPTION OF PREFERRED EMBODIMENTS

Figure 1:
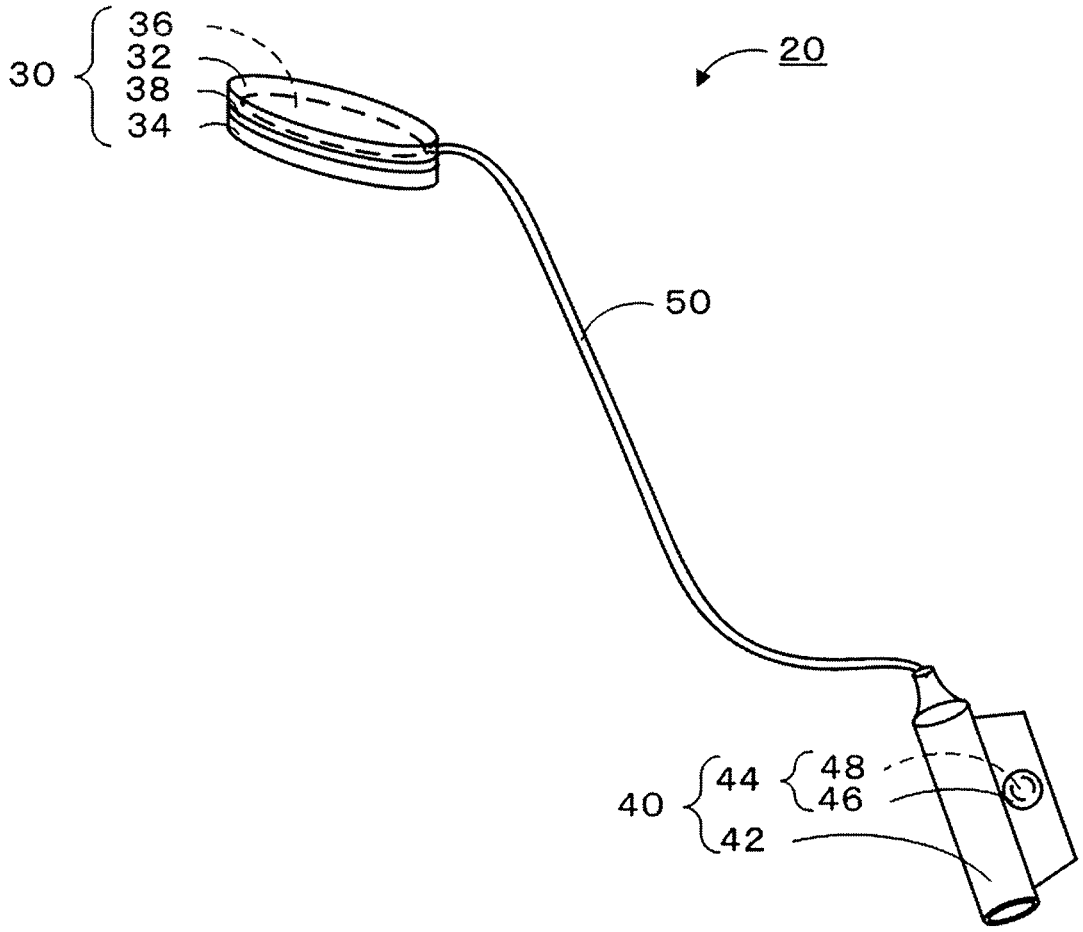
FIG. 1 is an explanatory diagram showing the schematic configuration of a contact pickup 20.

Here, based on the drawings briefly explained above, the correspondence relationships between the constituent elements of the embodiments and the constituent elements of the present invention are clarified to explain the embodiments of the present inventions. The ukulele 10 of the embodiments corresponds to a musical instrument of the present invention. Similarly, the contact pickup 20 corresponds to a transducer, a piezoelectric element 36 corresponds to a transducing member, a first magnet member 32 corresponds to a supporting member, a second magnet member 34 corresponds to a fixing member, a chamois leather 38 corresponds to a buffer member, a double-face adhesive tape 52 corresponds to an adhesive element, an output terminal 42 corresponds to an output terminal, a third magnet member 46 corresponds to an output-terminal supporting member, and a fourth magnet member 48 corresponds to an output-terminal fixing member. One example of usage of the contact pickup 20, which is one example of the embodiments of the present invention, will be clarified by explaining the attachment method of the contact pickup 20 to the ukulele 10.

Now, referring to FIG. 1, the configuration of the contact pickup 20, which is one example of the embodiments of the present invention, will be explained in detail. Here, FIG. 1 is an explanatory diagram showing the schematic configuration of the contact pickup 20. This contact pickup 20 has: a receiver unit 30 including the piezoelectric element 36 which detects vibrations from a sound source; and the output unit 40 including the output terminal 42. The receiver unit 30 and the output unit 40 are electrically connected with each other through a connecting cord 50. In addition, the surface of the receiver unit 30 and the connecting cord 50 is covered with an insulating layer made of rubber (not shown).

The receiving section 30 has: the first magnet member 32 supporting the piezoelectric element 36; and the second magnet member 34 placed opposite to the first magnet member 32. The first magnet member 32 and the second magnet member 34 attract each other with a magnetic force. The first magnet member 32 and the second magnet member 34 each contains a neodymium magnet having a diameter of 20 mm and a thickness of 5 mm. When this receiver unit 30 is attached, it is positioned such that the chamois leather 38 having a thickness of 0.5 mm is placed between the first magnet member 32 and the ukulele 10, and a part of the ukulele 10 is pinched between the first magnet member 32 and the second magnet member 34 (see FIG. 3).

As shown in FIG. 1, the piezoelectric element 36 is electrically connected to the connecting code 50, and is a known piezoelectric element made by TAMURA Denki, which a force (vibration) given on the surface of the piezoelectric body is transduced into a voltage by a piezoelectric effect. In this manner, sounds generated from the ukulele 10 are transduced into electric signals, and the electric signals are output from the output terminal 42 through the connecting code 50.

The output unit 40 has: an output terminal 42; and an output-terminal fixing member 44 for fixing the output terminal 42. The output terminal 42 is connected to a speaker (not shown) through an input plug (not shown). In this manner, sounds generated from the ukulele 10 can be output from the speaker (not shown) at a large volume.

The output-terminal fixing member 44 has: a third magnet member 46 attached to the output terminal 42; and a fourth magnet member 48 movably positioned by the third magnet member 46 and a magnetic force. The third magnet member 46 and the fourth magnet member 48 attract each other with a magnetic force. The third magnet member 46 and the fourth magnet member 48 each includes a neodymium magnet having a diameter of 20 mm and a thickness of 5 mm. This output-terminal fixing member 44 positions the location of the output terminal 42 by pinching a part of the ukulele 10 between the third magnet member 46 and the fourth magnet member 48 (see FIG. 2).

Now, referring FIG. 3, the attachment method of the receiving portion 30 to the ukulele 10 will be explained in further detail. Here, FIG. 3 is an exemplary diagram for attaching the contact pickup 20 to the ukulele 10, and is a partial cross section view where the ukulele 10 shown in FIG. 2 is cut from near the sound hole 12 to near the receiver unit 30.

Figure 3A:
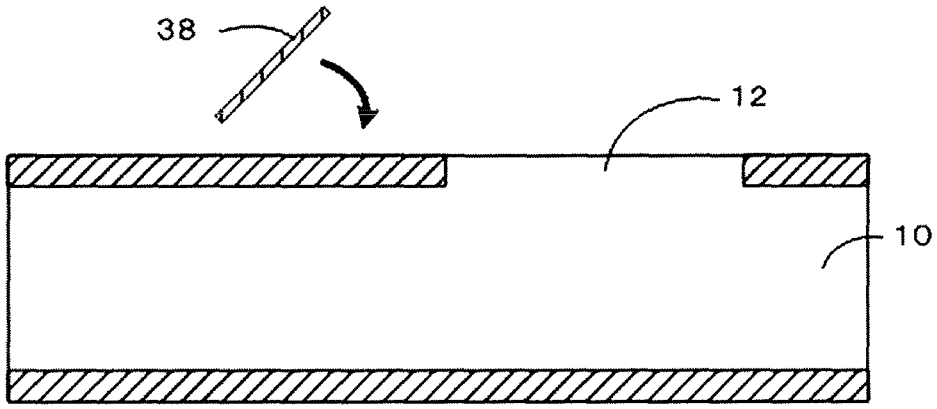
FIG. 3 an explanatory diagram showing how the contact pickup 20 is attached.

When the contact pickup 20 is attached to the ukulele 10, firstly the chamois leather 38 is placed adjacent to the sound hole 12 provided in the ukulele 10 as shown in FIG. 3A. Here, the location where the chamois leather 38 is positioned may be any location where the second magnet member 34 is easily placed from the inner side of the ukulele 10. The receiving portion 30 can be moved after the second magnet member 34 is placed.

Figure 3B:
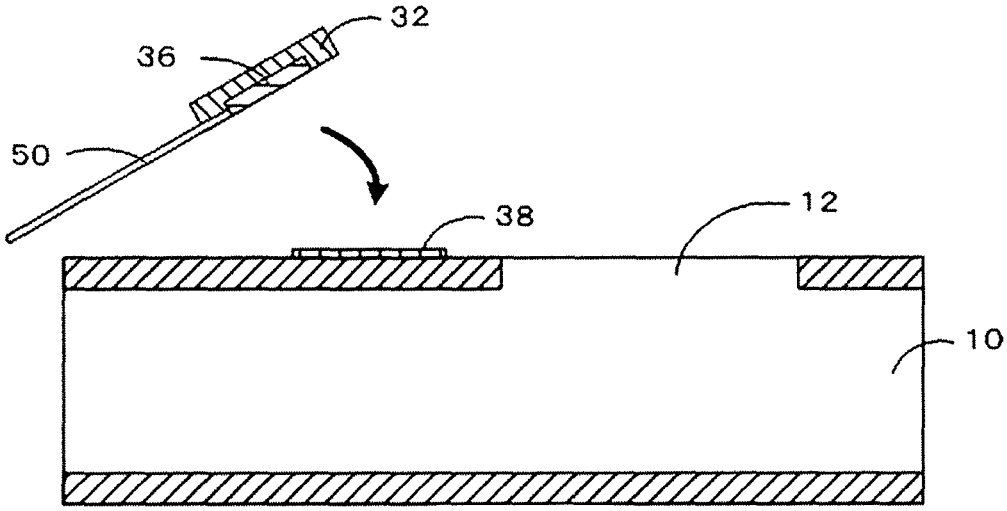
Figure 3C:
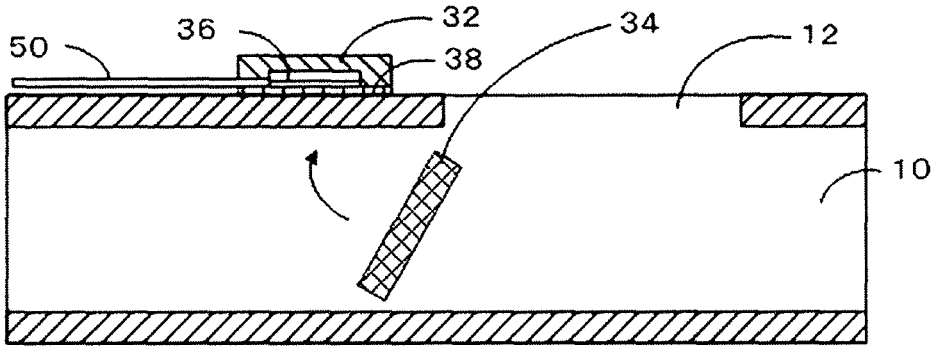

Then, as shown in FIG. 3B, the first magnet member 32 is positioned such that the piezoelectric element 36 is located at the chamois leather 38 side, in which the ukulele 10, the chamois leather 38 and the first magnet member 32 are arranged in order, and, as shown in FIG. 3C, the second magnet member 34 is brought close to a location opposite to the first magnet member 32 and the face plate of the ukulele 10, from the inner side. At this time, the first magnet member 32 and the second magnet member 34 are brought closer to each other so that their attracting faces (i.e., faces that attract each other with a magnetic force) face to each other. In this manner, the second magnet member 34 is attracted by the magnetic force of the first magnet member 32 to the position opposite to the first magnet member 32 via the face plate of the ukulele 10. Thereby, the receiver unit 30 is positioned on the front surface of the ukulele 10. At this time, since the receiver unit 30 is positioned by the first magnet member 32 and the second magnet member 34 attracting each other with a magnetic force, the receiver unit 30 can be moved by moving the first magnetic member 32 along with the surface of the ukulele 10. In other words, the receiver unit 30 can be positioned at any desired location.

Figure 2:
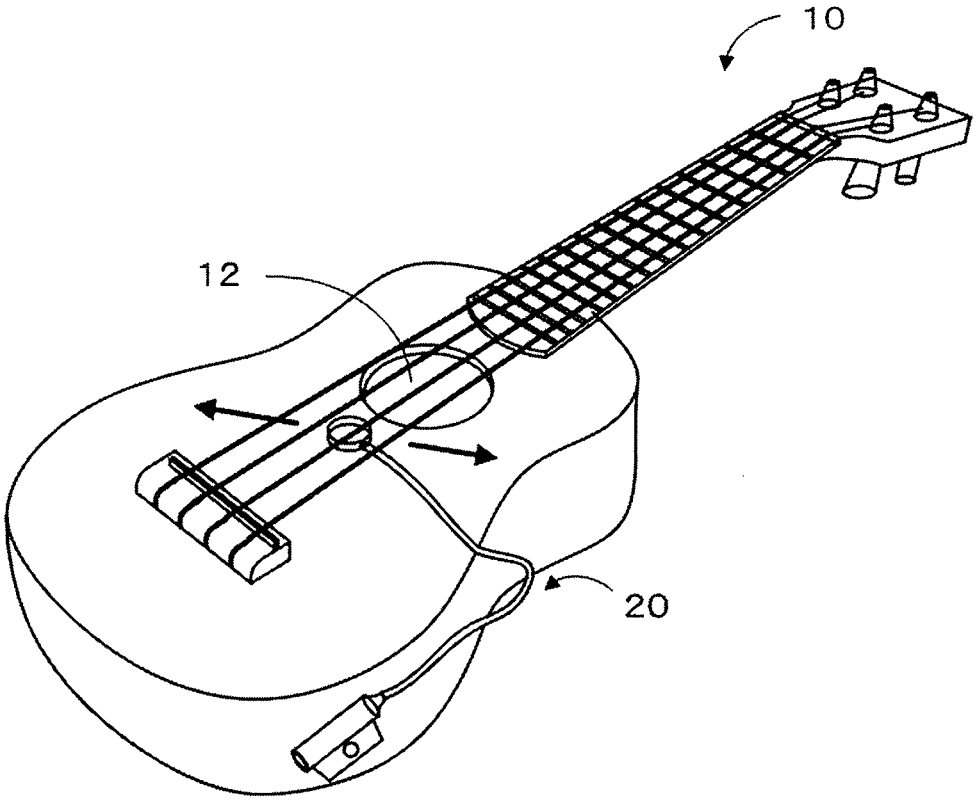
FIG. 2 is an explanatory diagram showing a state, in which the contact pickup 20 is attached to a ukulele 10.

In addition, the output unit 40 can be positioned at any desired location as shown in FIG. 2, by using the third magnet member 46 and the fourth magnet member 48. An explanation for the attachment method of the output unit 40 is omitted here as it is similar to the receiver unit 30.

Figure 4:
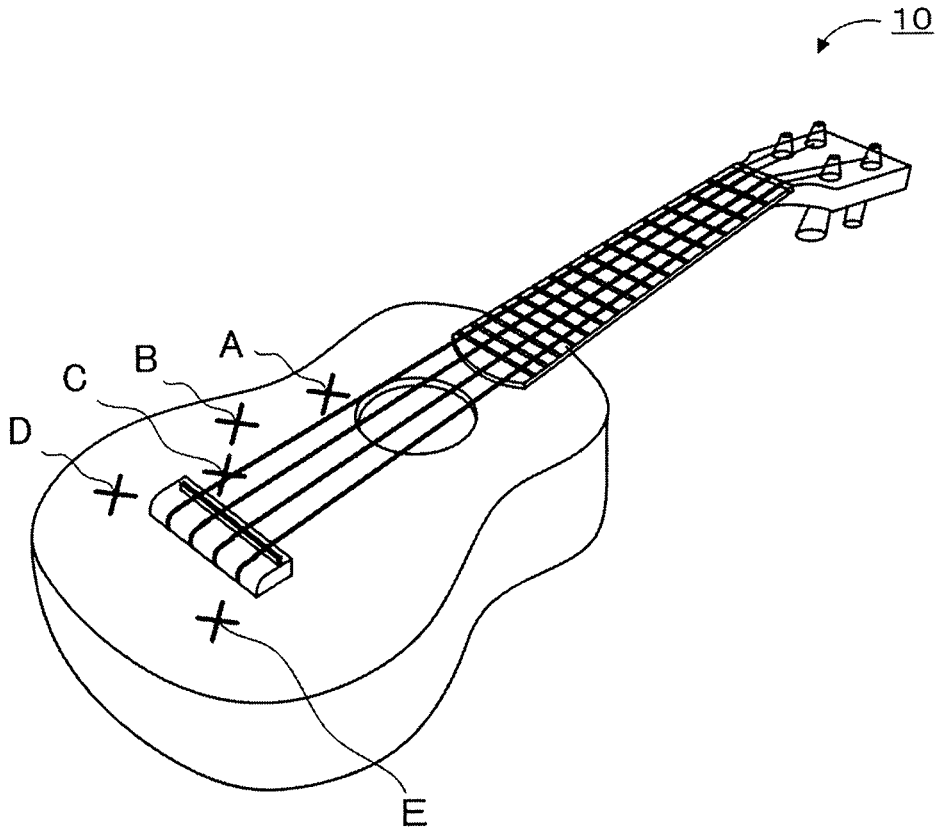
FIG. 4 is an explanatory diagram showing the attachment position of the receiver unit.

Here, a confirmation test was carried out as to how the sounds generated by the ukulele 10 changes depending on the location of the receiver unit 30 when they are output via the contact pickup 20. Specifically, the receiver unit 30 is positioned at locations A-E in FIG. 4, and the peak hold values of the sound signals output from the contact pickup 20 were measured.

The results are shown in FIGS. 5A-5E. FIGS. 5A-5E are comparison graphs, which were made in a manner that the receiver unit 30 is positioned at locations A-E in FIG. 4, and that the peak hold obtained at each location is measured. In the graphs of FIG. 5A-5E, the vertical axis is a volume (dB), and a horizontal axis is a frequency (Hz). Here, in FIG. 5A, the receiver unit 30 was positioned at location A in FIG. 4, and first string A, second string E, third string C, and fourth string G of the ukulele 10 were tuned to 440.00 Hz, 311.13 Hz, 261.63 Hz, 392.00 Hz, respectively. And then, the fourth string, the third string, the second string and the first string were plucked in this order with all the strings open, and the peak hold value of the sound signals obtained from the contact pickup 20 at each location was measured. FIG. 5B-FIG. 5E show results obtained by the measurement under the same conditions except that the receiver unit 30 is positioned at locations B-E in FIG. 4. As is clear from these results, big differences were confirmed in the measurement results depending on the installation location of the receiver unit 30. These results show that there are big differences in the spectrum of sound signals obtained from the contact pickup 20 depending on the attachment location of the receiver unit 30 to the ukulele 10, which means that the sounds differ depending on the attachment location of the receiving portion 30 to the ukulele 10.

Figure 5A:
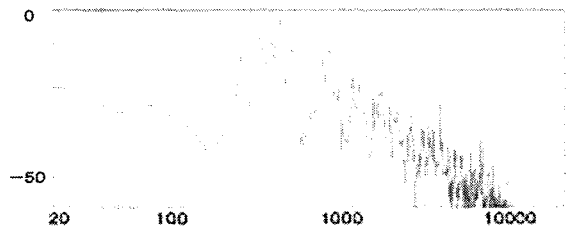
FIGS. 5A-5E are comparison graphs where the differences in peak hold are compared depending on the attachment position of the receiver unit.
Figure 5B:
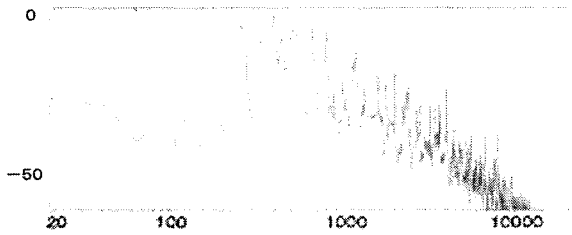
Figure 5C:
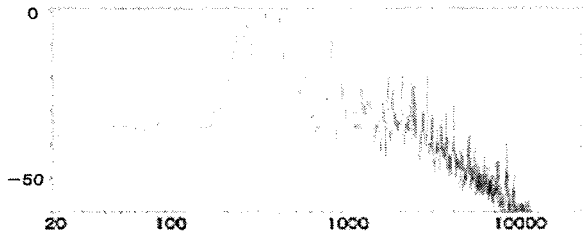
Figure 5D:
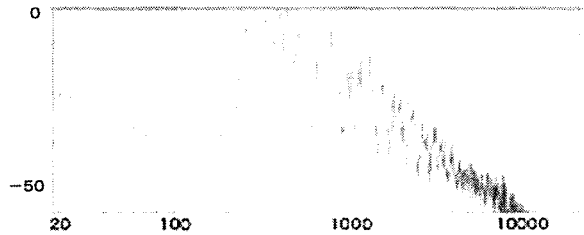
Figure 5E:
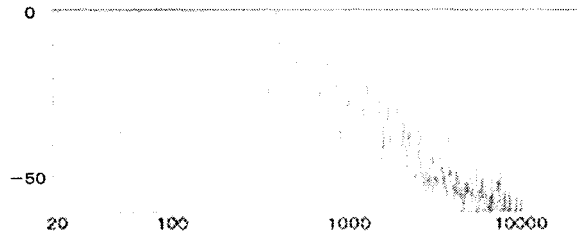

Any player naturally desires to play sounds that he/she images. For example, when the player conducts a solo performance, and wants to clearly express sounds one by one, it is desired that the receiver unit 30 is positioned at a location where fundamental tones and harmonic overtones are output in a proper balance. In such a case, as shown in FIG. 5A-5E, the results of the peak hold obtained from the receiver unit 30 positioned at each location are compared with each other, and then FIG. 5C is selected, in which the fundamental tones and the harmonic overtones are balanced. In other words, the receiver unit 30 is positioned at location C in FIG. 4. Similarly, for example, when the bass is desired to be dropped in a stroke play method, the receiver unit 30 is positioned at location E in FIG. 4, and on the other hand, when the bass is desired to be emphasized for playing, it is positioned at location B or D in FIG. 4, and thereby sounds that the player desires can be output. The free movement of the location where the receiving portion 30 is positioned allows not only the player to output desired sounds, but also the player to search for a location where the desired sounds are output.

Next, a confirmation test was conducted as to how the sensitivity of the piezoelectric element 36 changes depending on the pushing force on the front surface side of the ukulele 10. Specifically, it was measured in a manner that the piezoelectric element 36 was pushed against the surface of the ukulele 10 in a case that the piezoelectric element 36 was attached on the front surface of the ukulele 10 with a double-side adhesive tape, which is typically used for attaching a contact pickup, and in a case that the first magnet member 32 and the second magnet member 34 were used. Then the results were compared with reach other.

Figure 6A:
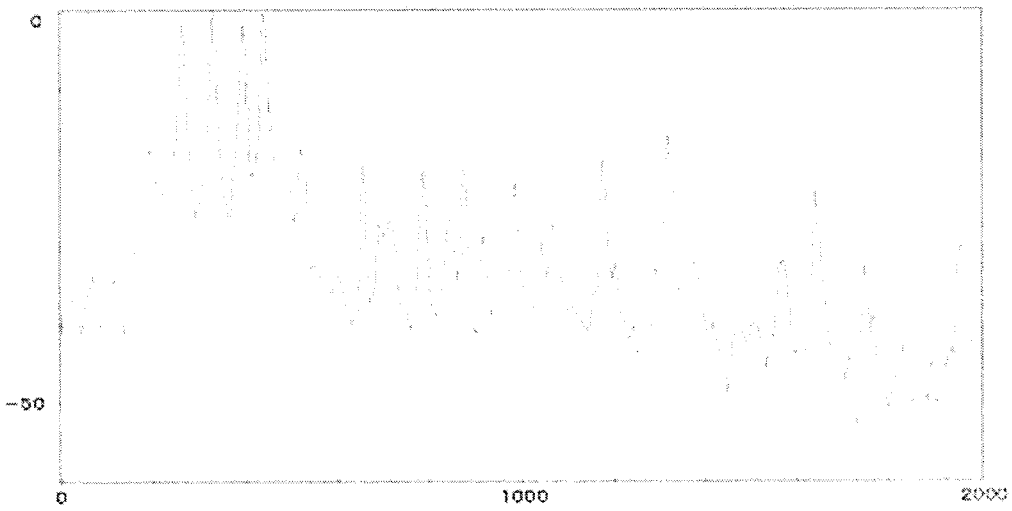
FIGS. 6A-6B are comparison graphs showing the difference in sound waveform depending on the attachment method of the receiver unit.
Figure 6B:
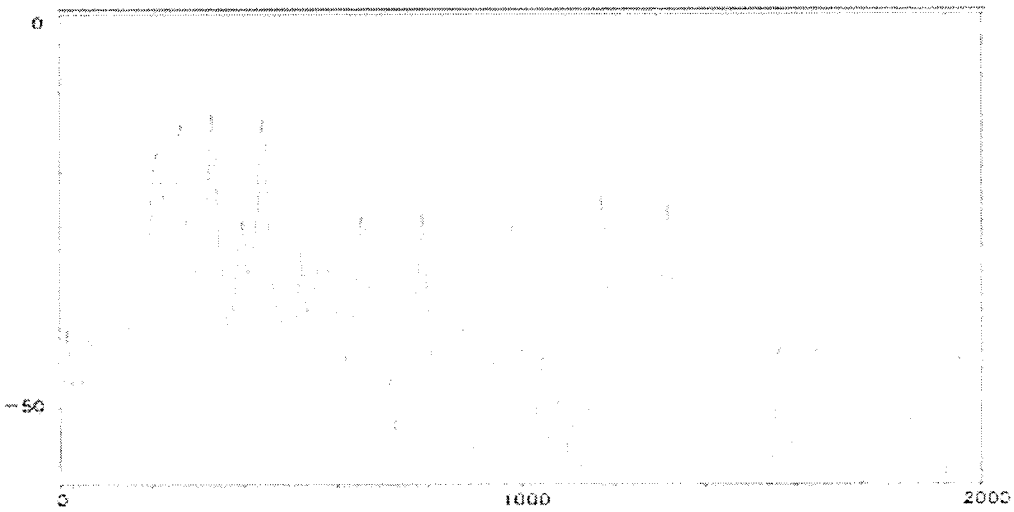

The results are shown in FIGS. 6A and 6B and FIGS. 7A and 7B. FIGS. 6A and 6B show comparison graphs showing the measured results, in which the difference in frequency spectrum due to the difference of the fixing method of the piezoelectric element 36 is measured. In the graphs of FIGS. 6A and 6B, the vertical axis is a volume (dB) and a horizontal axis is a frequency (Hz). Here, FIG. 6A shows a result obtained in a manner that the receiver unit 30 was positioned in the same manner as the above embodiment, and the first string A, the second string E, the third string C, the fourth string G of the ukulele 10 were tuned to 440.00 Hz, 329.63 Hz, 523.25 Hz, 392.00 Hz, respectively. And then, the fourth string, the third string, the second string and the first string were plucked in this order with all the strings open, and the peak hold value of the sound signals obtained from the contact pickup 20 at each location was measured. In addition, FIG. 6B shows a result measured under the same condition except that the receiver unit 30 is bonded to the ukulele 10 with a double-side adhesive tape. As is clear from these results, it was confirmed that the maximum amplitude is larger when the piezoelectric element 36 is positioned using the first magnet member 32 and the second magnet member 34. From these results, it can be said that when the piezoelectric element 36 is pushed against the ukulele 10, vibrations generated from the ukulele 10 can be received with a better sensitivity as compared with the case that the piezoelectric element 36 is bonded to the surface of the ukulele 10 with a double-side adhesive tape.

Figure 7A:
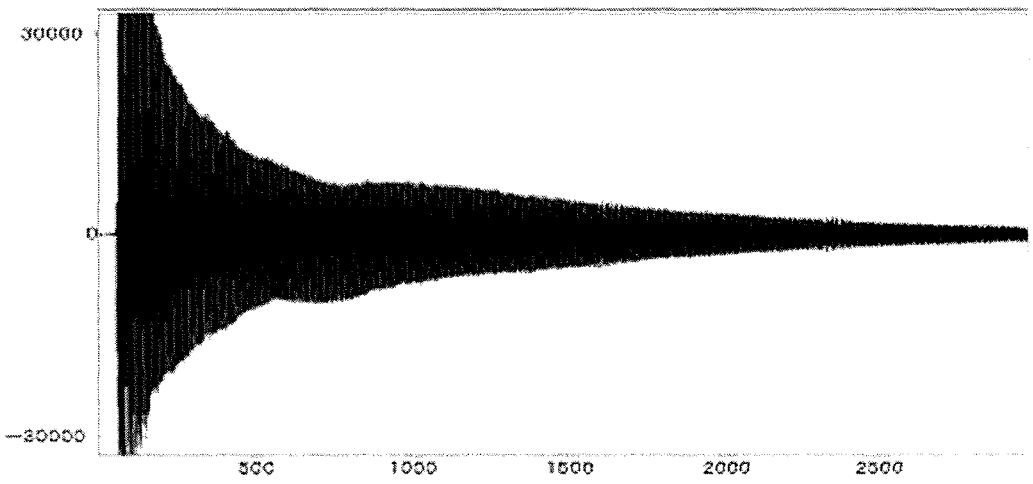
FIGS. 7A-7B are comparison graphs showing the difference in frequency spectrum depending on the attachment method of the receiver unit.
Figure 7B:
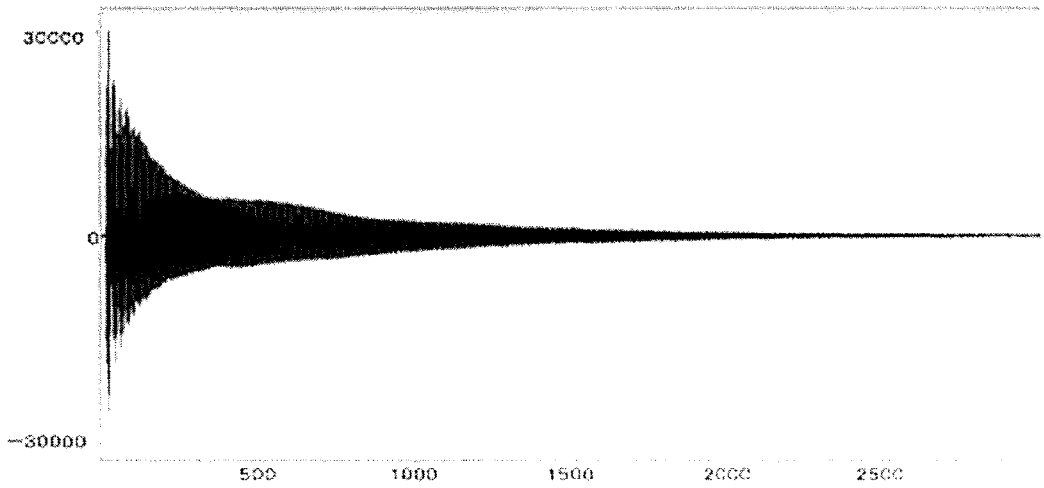

FIGS. 7A and 7B show comparison graphs showing the measured results, in which the difference in sound waveform due to the difference of the fixing method of the piezoelectric element is measured. In the graphs of FIGS. 7A and 7B, the vertical axis represents an effective value, and the horizontal axis represents time (millisecond). An explanation of the test conditions is omitted because the test conditions are the same as those when the difference in frequency spectrum due to the difference of the fixing method of the piezoelectric element were measured (FIGS. 6A and 6B). As is clear from these results, the maximum amplitude becomes larger and the signal duration becomes longer when the piezoelectric element 36 is positioned using the first magnet member 32 and the second magnet member 34. Therefore, it can be said that when the piezoelectric element 36 is pushed against the ukulele 10, vibrations generated from the ukulele 10 can be received with a better sensitivity, as compared with the case that the piezoelectric element 36 is bonded on the surface of the ukulele 10 with a double-face adhesive tape.

When the contact pickup 20 is removed, it may be removed by moving the receiver unit 30 and the output unit 40 to the sound hole 12, or it may be removed by removing the first magnetic member 32 and the third magnetic member 46 and removing the second magnet member 34 and the fourth magnet member 48 out of the ukulele 10 from the sound hole 12. In any method, since no adhesive or the like is used to position the contact pickup 20, this can reduce the possibility that any adhesive remains on the surface of the ukulele 10 when the contact pickup 20 is removed, or that the surface of the ukulele 10 is damaged when the adhesive is removed.

According to the contact pickup 20 of the above described embodiment, the first magnet member 32 and the second magnet member 34 attract each other with a magnetic force, pinching the face plate of the ukulele 10, and thereby the receiver unit 30 including the piezoelectric element 36 supported by the first magnet member 32 can be positioned at a desired location. Here, the receiver unit 30 is positioned only by magnetic forces mutually attracting, and thereby it can be moved to a desired location after it was positioned on the surface of the ukulele 10. Moreover, as the contact pickup 20 is positioned on the surface of the ukulele 10 only by a magnetic force, it can be removed without leaving any mark on the surface of the ukulele 10 after use. In other words, the receiver unit 30 can be positioned at a desired location in a removable condition without damaging the surface of the ukulele 10 or leaving any mark on the ukulele 10 when removed.

In addition, when the receiver unit 30 is positioned, the piezoelectric element 36 is positioned in a condition, in which it is pushed against the front surface side of the ukulele 10 by the first magnet member 32 and the second magnet member 34 attracting each other. Therefore, vibrations generated from the musical instrument can be detected with a better sensitivity, as compared with the case that the piezoelectric element 36 is bonded to the front surface side of the ukulele 10 with a double-side adhesive tape or the like.

Furthermore, since the piezoelectric element 36 is positioned on the front surface side of the ukulele 10, the connecting cord 50 electrically connected with the output terminal 42 can always be located at the outer surface side of the ukulele 10. Therefore, it is not necessary to provide the ukulele 10 with a through hole for outputting electric signals toward the outside unlike in the conventional contact pickup. In other words, the contact pickup 20 can be attached without damaging the ukulele 10.

In addition, since the output unit 40 is positioned on the front surface side of the ukulele 10 by the third magnet member 46 and the fourth magnet member 48, the output unit 40 is disengaged from the front surface of the ukulele 10 when a force exceeding the magnetic force of the third magnet member 46 and the fourth magnet member 48 is added to the pickup cable or the like connected to the output terminal 42. Therefore, the possibility that an excessive force is added to the ukulele 10 and damages the ukulele 10 can be reduced in advance, as compared with the case that the output unit 40 is bonded to the ukulele 10. In addition, since the receiver unit 30 is also positioned by the first magnet member 32 and the second magnet member 34, the same effect is acquired.

In addition, since both of the first magnet member 32 and the second magnet member 34 are neodymium magnets, the ukulele 10 is pinched by a stronger force as compared with magnetite, a ferrite magnet or the like, and the possibility that the receiver unit 30 is displaced inadvertently, or the contact pickup 20 is disengaged during the playing of the ukulele 10 can be reduced in advance.

Here, it should be appreciated that the present invention is not limited to the above described embodiment, but may be carried out in various aspects as far as these aspects belong to the technical scope of the present invention.

For example, although in the above described embodiment, both of the first magnet member 32 and the second magnet member 34 are neodymium magnets, the present invention is not limited to it as far as the magnet has a magnet force capable of supporting the piezoelectric element 36, and other magnets such as magnetite and ferrite magnet may be used. Moreover, only one of the first magnet member 32 and the second magnet member 34 may be a magnet, and the other may be a magnetic body that is attractable by a magnetic force. In any case, the advantageous effect of the above described embodiment can be obtained. The same applies to the third magnet member 46 and the fourth magnet member 48.

Although in the above described embodiment, a neodymium magnet having a diameter of 20 mm and a thickness of 5 mm is used as the second magnet member 34, the size of the second magnet member 34 is not limited to it, but for example a neodymium magnet having a diameter of 12 mm and a thickness of 1.7 mm may be used. In this manner, the attracting force of the first magnet member 32 and the second magnet member 34 due to a magnetic force can be reduced, and the pushing force that the piezoelectric element 36 is pushed against the front surface of the ukulele 10 can be reduced. By adjusting the pushing force that the piezoelectric element 36 is pushed against the front surface of the ukulele 10 in this manner, the sound quality that is output from the contact pickup 20 can be changed, and thereby sounds desired by the player can be obtained.

Figure 8A:
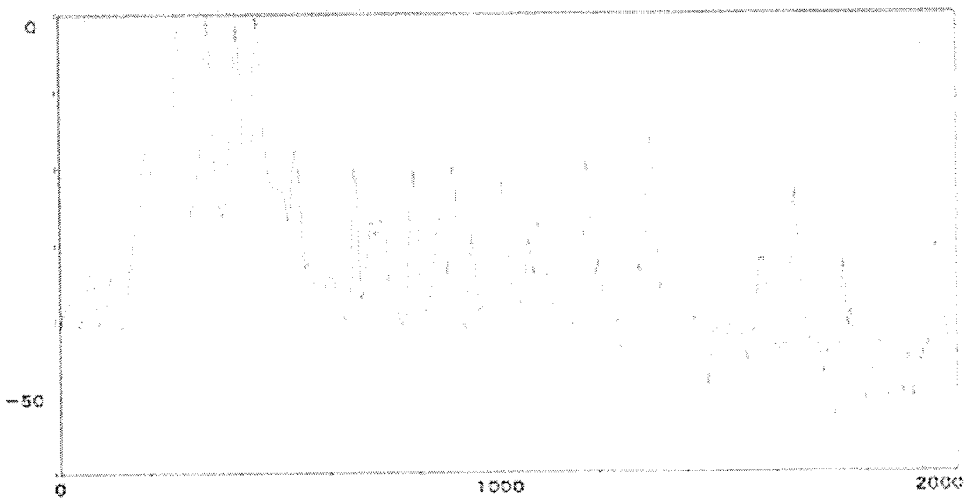
FIGS. 8A-8B are comparison graphs showing the difference in sound waveform depending on the size of the second magnet member.
Figure 8B:
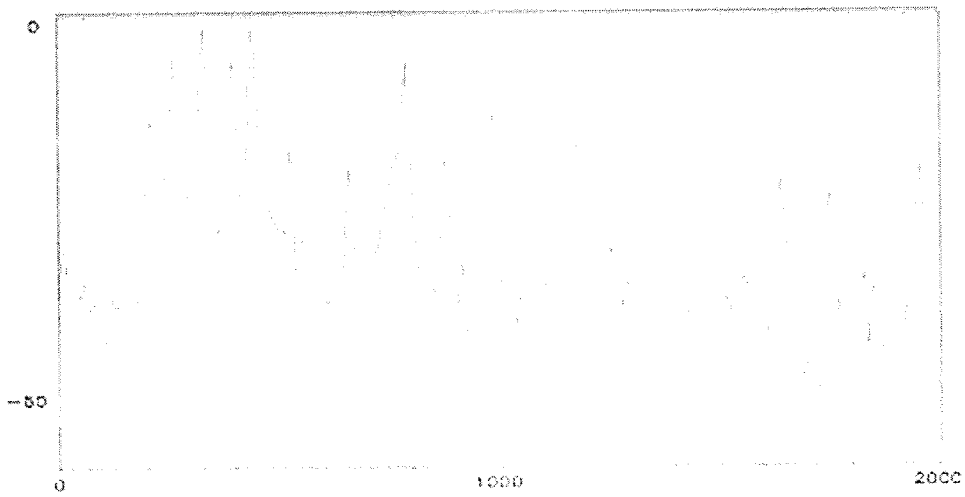

Here, how the difference in the size of the secondary magnet member 34 make a change in the sound quality will be explained in detail with reference to FIGS. 8A and 8B and FIGS. 9A and 9B. FIGS. 8A and 8B show comparison graphs showing results that the difference in frequency spectrum depending on the size of a magnet is measured, and in the graph of FIG. 8, the vertical axis represents a volume (dB) and the horizontal axis represents a frequency (Hz). Here, in FIG. 8A, the receiver unit 30 was positioned using the second magnet member 34, and the first string A, the second string E, the third string C and the fourth string G of the ukulele 10 were tuned to 440.00 Hz, 329.63 Hz, 523.25 Hz, 392.00 Hz, respectively. And then, the fourth string, the third string, the second string and the first string were plucked in this order with all the strings open, and the peak hold value of the sound signals obtained from the contact pickup 20 at each location was measured. In addition, FIG. 8B shows a result measured under the same condition except that the second magnet member 34 was replaced with another magnet having a diameter of 12 mm and a thickness of 1.7 mm. As is clear from these results, it was confirmed that, when a magnet smaller than the second magnet member 34 is used, the peak hold of each sound is more broadly output. Thus, when the pushing force that pushes the piezoelectric element 36 to the ukulele 10 is small, the output volume can be reduced. In other words, even if a piezoelectric element having a good sensitivity is used, the possibility that the peak of the piezoelectric element is surpassed can be reduced in advance, and the possibility that the output sound is distorted or the output level of the output sound remains unchanged due to surpassing the peak can be reduced. Changing the pushing force to the piezoelectric element in this manner allows various kinds of piezoelectric elements to be used regardless the sensitivity of the piezoelectric elements.

Figure 9A:
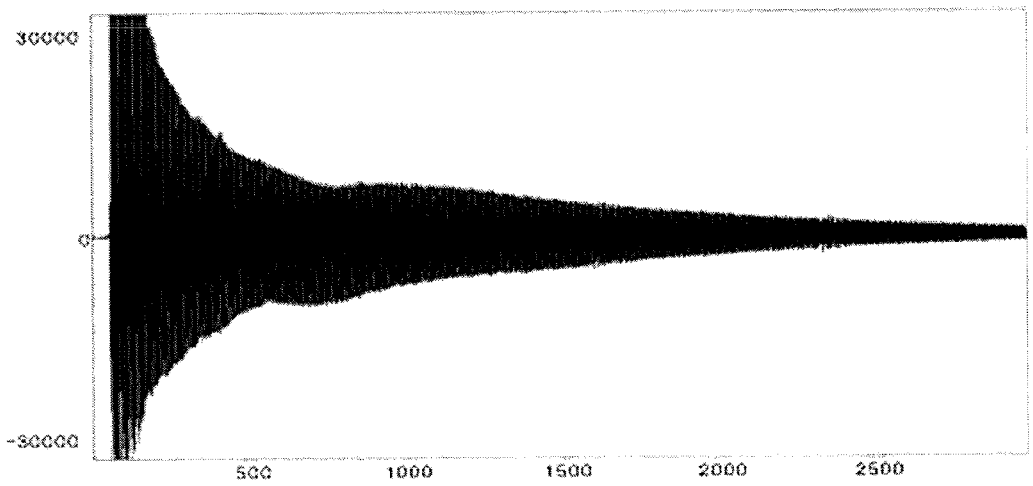
FIGS. 9A-9B are comparison graphs showing the difference in frequency spectrum depending on the size of the second magnet member.
Figure 9B:
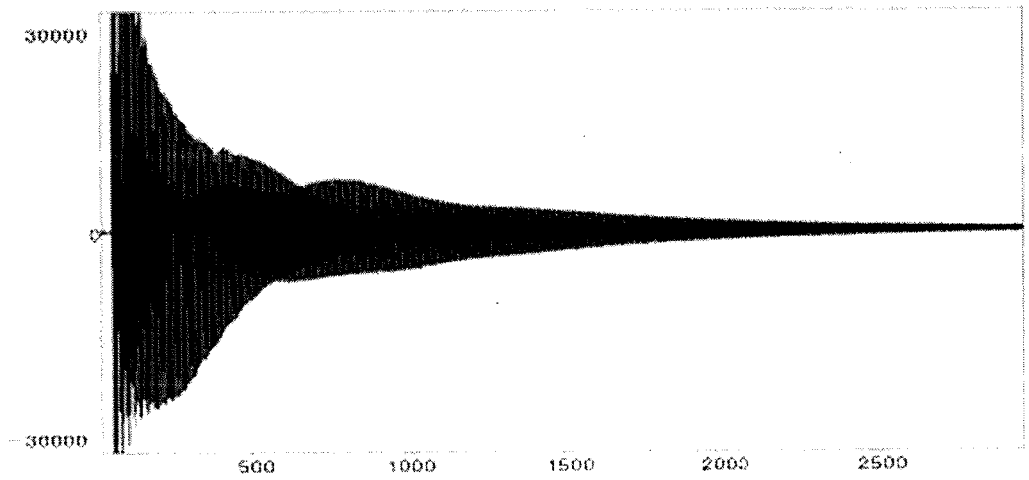

Next, the difference in sound waveform depending on the size of the second magnet member 34 was measured. FIGS. 9A and 9B show comparison graphs showing the difference in sound waveform depending on the size of the second magnet member 34, and in the graphs of FIGS. 9A and 9B, the vertical axis represents an effective value, and the horizontal axis represents time (millisecond). Here, FIG. 9A shows a result measured in a manner that the receiver unit 30 was positioned using the second magnet member 34, and the first string A, the second string E, the third string C and the fourth string G of the ukulele 10 were tuned to 440.00 Hz, 329.63 Hz, 523.25 Hz, 392.00 Hz, respectively, and only the third string was plucked. In addition, FIG. 9B shows a result measured under the same condition except that the second magnet member 34 was replaced with another magnet having a diameter of 12 mm and a thickness of 1.7 mm. As is clear from these result, it was confirmed that, when a magnet smaller than the second magnet member 34 is used, the maximum amplitude becomes larger and the signal duration becomes longer. Thus when the pushing force for pushing the piezoelectric element 36 against the ukulele 10 is small, a sound having a lingering tone that is shorter and dies down faster can be output.

Although in the above embodiment, the chamois leather 38 is inserted between the ukulele 10 and the piezoelectric element 36, the present invention is not limited to this, but a buffer member may be appropriately inserted in accordance with the sounds desired by the player. For the buffer member, a felt or cotton cloth of 1.5 mm, a natural rubber of 1 mm, a hard rubber of 1 mm, a walnut wood of 0.5 mm, a balsa material of 1 mm, or the like may be used for example. Changing the material or thickness of the buffer member allows the sound quality/tone output from the contact pickup 10 to be changed to the sound quality/tone desired by the player.

Figure 10A:
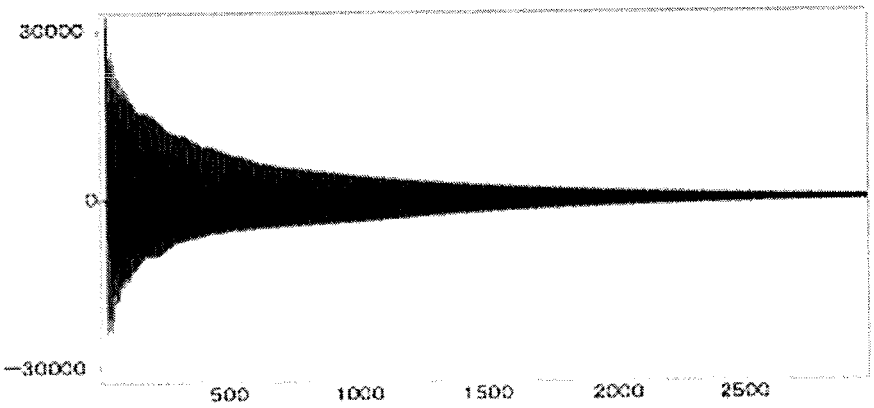
FIGS. 10A-10C are comparison graphs showing the differences in frequency spectrum depending on the type of the buffer member.
Figure 10B:
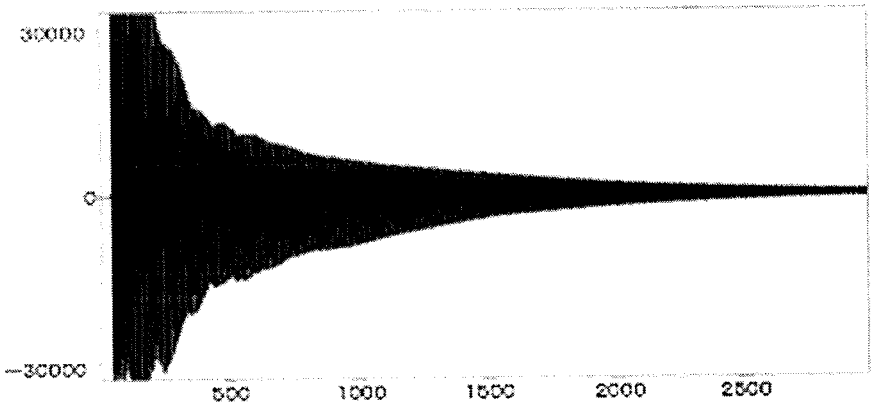
Figure 10C:
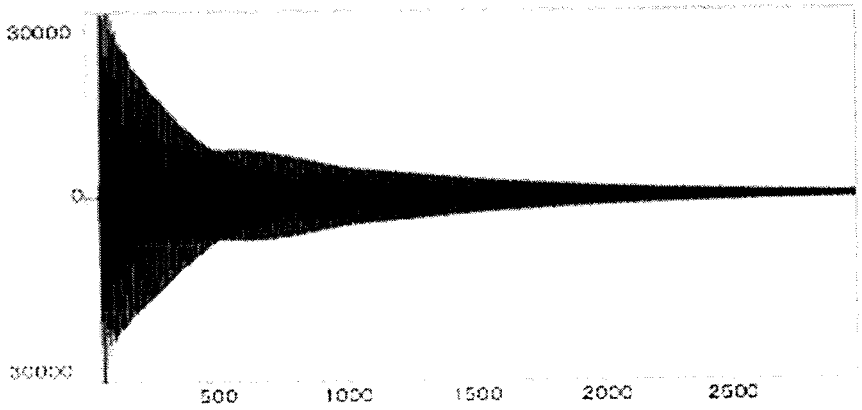
Figure 11A:
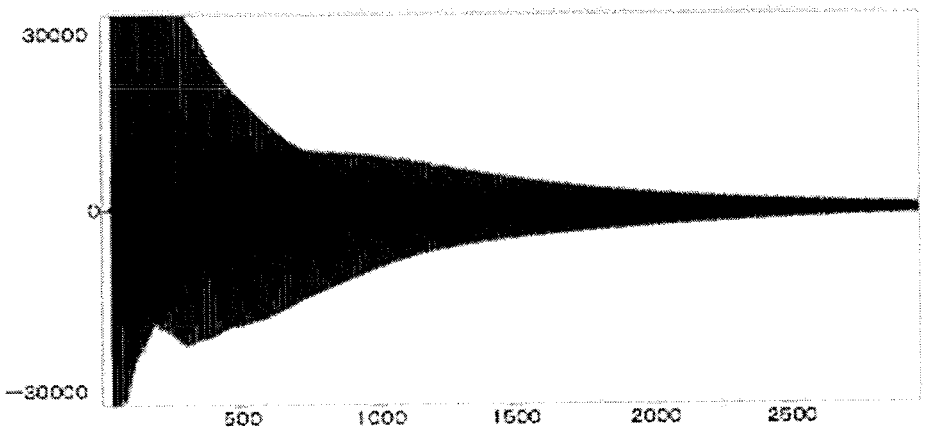
FIGS. 11A-11C are comparison graphs showing the differences in frequency spectrum depending on the type of the buffer member.
Figure 11B:
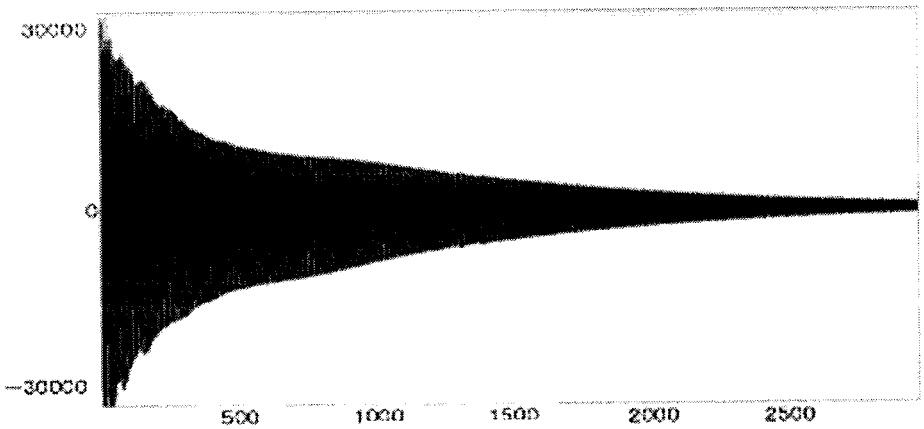
Figure 11C:
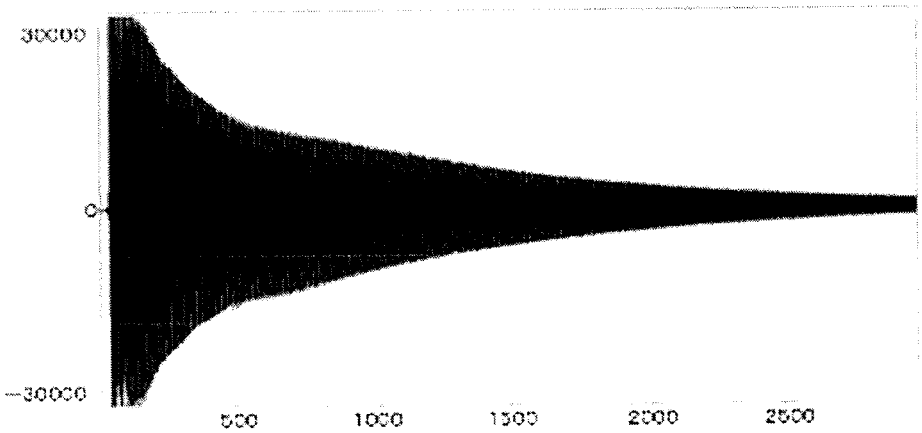

Here, the changes of the sound quality depending on the material of the buffer member will be explained in detail with reference to FIGS. 10A-10C and FIGS. 11A-11C. FIGS. 10A-10C and FIGS. 11A-11C show comparison graphs showing the differences in sound waveform, in which the changes of the sound quality/tone were measured depending on the type of a buffer member. In the graphs of FIGS. 10A-10C and FIGS. 11A-11C, the vertical axis represents an effective value, and the horizontal axis represents time (millisecond). Here, FIG. 10A shows a result measured in a manner that a felt having a thickness of 1.5 mm, and the first string A, the second string E, the third string C, the fourth string G of the ukulele 10 were tuned to 440.00 Hz, 329.63 Hz, 523.25 Hz, 392.00 Hz, respectively, and only the third string was plucked. FIG. 10B shows a result measured under the same condition as FIG. 10A except that the buffer material was replaced with a cotton cloth. FIG. 10C shows a result measured under the same condition as FIG. 10A except that the buffer material was replaced with a natural rubber having a thickness of 1 mm. FIG. 11A shows a result measured under the same condition as FIG. 10A except that the buffer material was replaced with a hard rubber having a thickness of 1 mm. FIG. 11B shows a result measured under the same condition as FIG. 10A except that the buffer material was replaced with a walnut wood having a thickness of 1 mm. FIG. 11C shows a result measured under the same condition as FIG. 10A except that the buffer material was replaced with a balsa wood having a thickness of 1 mm. As is clear from these results, when the felt having a thickness of 1.5 mm is used as the buffer material, a sound, of which the output is low and smoothly reduces, is obtained. When the cotton cloth is used, a sound that has a simmering impression and attenuates quickly is obtained. When the natural rubber having a thickness of 1 mm is used, a sound that has a surging impression and attenuates smoothly is obtained. When the hard rubber having a thickness of 1 mm is used, a sound that has a distortion impression and attenuates smoothly is obtained. When the walnut wood having a thickness of 0.5 mm is used, a sound that is natural and attenuates smoothly is obtained. When the balsa having a thickness of 1 mm is used, a sound that is natural with a strong attack sound and attenuates smoothly is obtained. In this manner, the contact pickup 20 can output sounds desired by the player by appropriately changing the buffer material.

Figure 12:
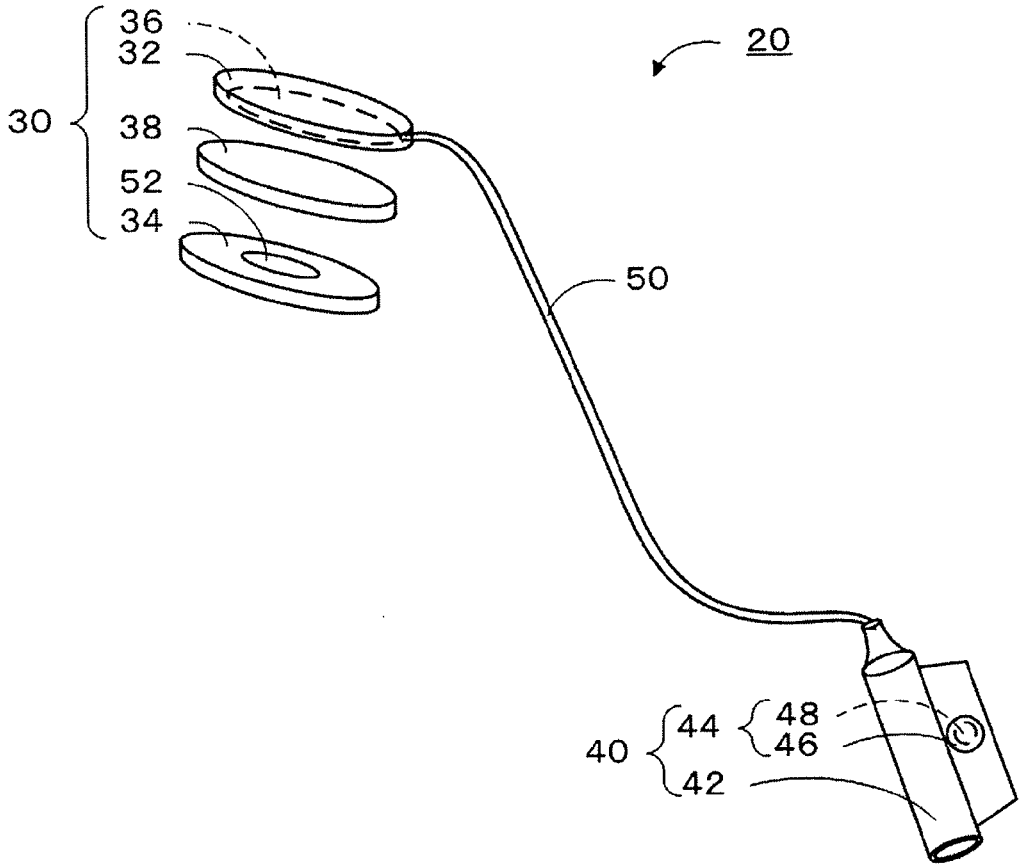
FIG. 12 is a schematic diagram showing the contact pickup 20 in another embodiment.

Although in the above embodiment, the receiver unit 30 is positioned by the magnet force of the first magnet member 32 and the second magnet member 34, the second magnet member 34 may have a double-side adhesive tape 52 on the surface as shown in FIG. 12. In this manner, the second magnet 34 can be bonded to the ukulele 10 after the receiver unit 30 is positioned in place, and thus the second magnet member 34 will remain bonded to the musical instrument even if the first magnet member 32 is removed. Therefore, even if the first magnet member 32 is removed once, it can be again positioned at the same location easily. FIG. 12 is a schematic diagram showing one example of the contact pickup 20, and an explanation of the attachment method of this contact pickup 20 to the ukulele 10 is omitted because it is the same as the attachment method of the above described contact pickup 20.

Figure 13:
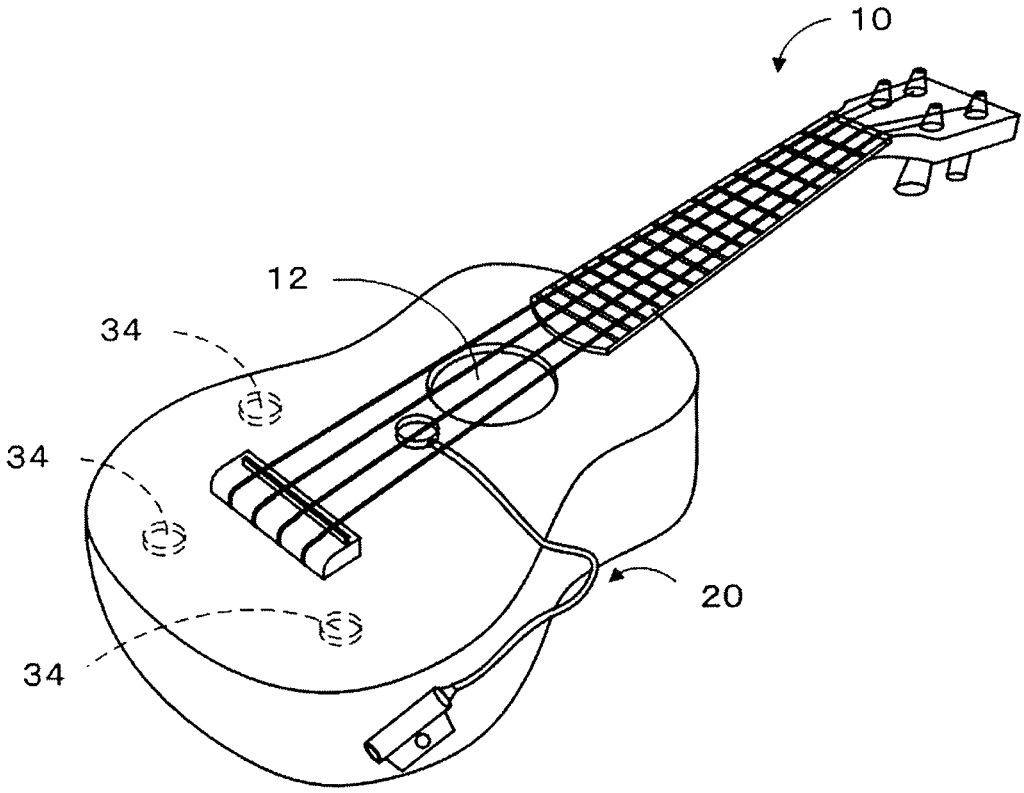
FIG. 13 is a schematic diagram showing the usage state of the contact pickup 20 in another embodiment.

The contact pickup 20 employing this embodiment may have a plurality of the second magnet members 34 as shown in FIG. 13. In this manner, the receiver unit 30 may be easily positioned at any location opposite to the locations of the second magnet members 34. In the other words, the receiver unit 30 may be easily positioned by fixing the second magnet members 34 at multiple locations in advance.

Although in the above embodiment, the second magnet member 34 is bonded to the ukulele 10 with the double-face adhesive tape 52, the present invention is not limited to this, but it can be other adhesive or gluing agents, or other adhesive tapes, for example. With any of them, the same advantageous effect as that of the above embodiment can be obtained.

Figure 14:
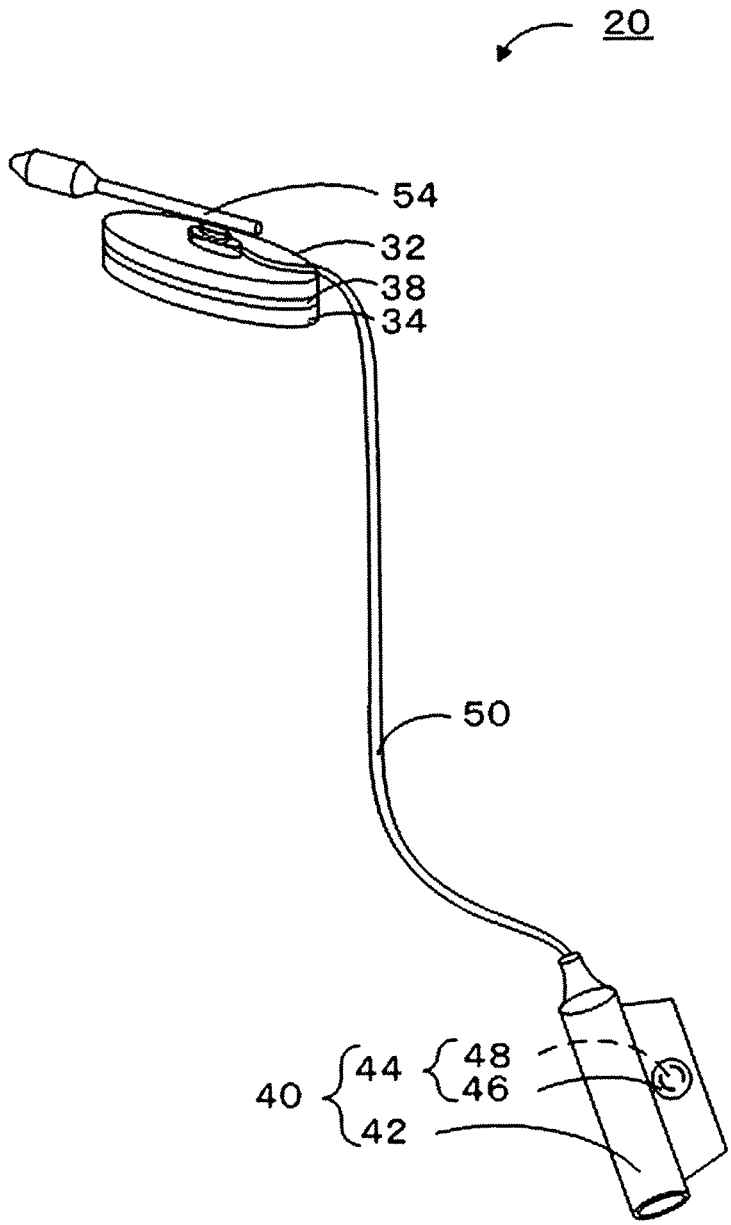
FIG. 14 is a schematic diagram showing the contact pickup 20 in another embodiment.

Although in the above described embodiment, the sound of the ukulele 10 is detected using the piezoelectric element 36, for example a moving-coil-type microphone, ribbon-type microphone, or capacitor-type microphone may be used. For example, when the capacitor-type microphone is used, the contact pickup 20, in which a capacitor-type microphone 54 is fixed on the surface of the first magnet member 32, can be used as shown in FIG. 14. In this manner, the same advantageous effect as that of the above described embodiment can be obtained.

Although the above embodiment was described in the form of the ukulele 10 as a musical instrument as an example, the present invention is not limited to this, but other sting instruments such as acoustic guitar, violin, viola and piano may be used, or other music instruments such as woodwind instrument, brass instrument and percussion instrument may be used. Any musical instruments that generate sounds by vibrations can obtain the same advantageous effect as that of the above described embodiment.

Industrial Applicability

As described in the above embodiment, the present invention can be used in a field that the sound of an acoustic instrument is electrically amplified and released, in particular, used as a contact pickup that transduces the sounds of a string instrument into electric signals.

Description of Reference Signs

10: Ukulele
12: Sound hole
20: Contact pickup
30: Receiver unit
32: First magnet member
34: Second magnet member
36: Piezoelectric element
38: Chamois leather
40: Output unit
42: Output terminal
44: Output-terminal fixing member
46: Third magnet member
48: Fourth magnet member
50: Connecting cord
52: Double-side adhesive tape
54: Capacitor-type microphone

The invention claimed is:

1. A transducer comprising:

a transducing member for transducing a vibration generated from a musical instrument into an electric signal;

a supporting member for supporting the transducing member;

a fixing member, placed opposite to the supporting member to pinch at least a part of the musical instrument, wherein at least one of the supporting member and the fixing member is a magnet, and the supporting member and the fixing member attract each other with a magnetic force to position the transducing member.

2. The transducer according to claim 1, wherein the transducing member is a piezoelectric element, and wherein the supporting member and the fixing member attract each other with a magnetic force to push the transducing member toward the musical instrument.

3. The transducer according to claim 2, comprising a buffer member inserted between the supporting member and the musical instrument when the transducing member is pushed against the supporting member.

4. The transducer according to claim 1, wherein the fixing member has an adhesive element for fixing the fixing member and the musical instrument to at least a part of an abutment surface where the fixing member and the musical instrument abut with each other when the fixing member is placed.

5. The transducer according to claim 4, wherein a plurality of fixing members are provided.

6. The transducer according to claim 5, comprising an output terminal electrically connected to the transducing member, and outputting an electric signal transduced by the transducing member.

7. The transducer according to claim 6, comprising:

an output-terminal supporting member for supporting the output terminal;

an output-terminal fixing member placed opposite to the output-terminal supporting member to pinch at least a part of the musical instrument, wherein at least one of the output-terminal supporting member and the output-terminal fixing member is a magnet, the output-terminal supporting member and the output-terminal fixing member attract each other with a magnetic force to position the output terminal on a front surface of the musical instrument.

8. The transducer according to claim 7, the supporting member and the fixing member are neodymium magnets.

* * * * *